United States Patent [19]

Takagi

[11] 4,386,041

[45] May 31, 1983

[54] METHOD FOR THE MANUFACTURE OF A CUSHIONING MATERIAL WHICH COMPRISES COMPRESSING SYNTHETIC FILAMENTS, APPLYING ADHESIVE AND HEATING, AND PRESSING THE RESULTANT MATERIAL IN THE PRESENCE OF STEAM

[76] Inventor: Sadaaki Takagi, 39, Mikage-cho, Okazaki-shi, Aichi-ken, Japan

[21] Appl. No.: 275,324

[22] Filed: Jun. 19, 1981

[30] Foreign Application Priority Data

Jun. 28, 1980 [JP] Japan ..... 55-88375

[51] Int. Cl.[3] ..... D04H 1/64

[52] U.S. Cl. ..... 264/128; 156/148; 156/154; 264/126; 264/248

[58] Field of Search ..... 264/128, 126, 248; 156/148, 154

[56] References Cited

U.S. PATENT DOCUMENTS 4,154,051 5/1979 Takagi ..... 57/332

4,172,174 10/1979 Takagi ..... 428/288

*Primary Examiner*—Maurice J. Welsh

*Attorney, Agent, or Firm*—Gordon W. Hueschen

[57] ABSTRACT

A method for the manufacture of a cushioning material comprising the steps of compressing three-dimensionally crimped short synthetic filaments to form a shaped mass of filaments, applying an adhesive agent to the resultant shaped mass of filaments, then heating the shaped mass thereby drying the adhesive agent adhering to said short filaments and uniting adjacent filaments at the points of their mutual contact, and pressing the resultant crude cushioning material in the presence of steam thereby compressing the crude cushioning material.

9 Claims, 10 Drawing Figures

METHOD FOR THE MANUFACTURE OF A CUSHIONING MATERIAL WHICH COMPRISES COMPRESSING SYNTHETIC FILAMENTS, APPLYING ADHESIVE AND HEATING, AND PRESSING THE RESULTANT MATERIAL IN THE PRESENCE OF STEAM

BACKGROUND OF THE INVENTION

1. Field of the Invention

This invention relates to a method for the manufacture of a cushioning material. More particularly, the invention relates to a method for the manufacture of a cushioning material comprising a three-dimensionally crimped filament mass of synthetic fiber, which cushioning material is capable of retaining its original cushioning property intact through prolonged repeated use.

2. Description of the Prior Arts

According to the inventors' earlier discovery, a cushioning material obtained by cutting three-dimensional crimped filaments to a prescribed length, wadding the cut filaments into a mass, disentangling the filaments from the mass and at the same time compressing them into a required shape and uniting the individual adjacent filaments at the points of their mutual contact by use of an adhesive agent possesses high impact resilience, shows permeability to gas and excels in cushioning property. According to the inventors' further discovery (U.S. Pat. No. 4,172,174) a cushioning material of a construction obtained by wadding synthetic filaments containing three-dimensionally crimped filaments into a mass and uniting the individual adjacent filaments in the mass at the points of their mutual contact by use of an adhesive agent exhibits still better properties when the curls in the filaments of the cushioning material are shaped so as to acquire directionality partially and, consequently, the portions in which curled or crimped filaments assuming various shapes during their extractive and contractive deformation are allowed to entangle more densely than in other portions, are formed in the direction in which the applied load is desired to produce its impact and the portions of such concentrated entanglement are distributed in proportion to the desired load strength.

This cushioning material is manufactured by compressing a wad of three-dimensionally crimped filaments into an aggregated block of filaments of a stated bulk density by means of an endless belt and/or a roller or some other means, needling the shaped block to a stated needle density with needles each provided with barbs and, with or without a subsequent rubbing treatment, either spraying an adhesive agent downwardly onto the shaped block of filaments on an endless belt in motion in a substantially horizontal direction or immersing the shaped block of filaments in a bath of the adhesive agent and lifting it from the bath, and thereafter drying the wet block of filaments on the endless belt running in a substantially horizontal direction by heating.

Although the cushioning material manufactured by this method exhibits permeability to gas and excels in cushioning property, it has a disadvantage that it undergoes accumulation of residual strain, a phenomenon known as "collapse," after prolonged repetitive use. Further, since this cushion is deficient in surface smoothness, it gives an unpleasant sensation to a person sitting or lying thereon.

An object of this invention, therefore, is to provide a method for the manufacture of a cushioning material which suffers very little accumulation of residual strain even after prolonged repetitive use.

SUMMARY OF THE INVENTION

The object described above is accomplished by a method which effects the manufacture of such a cushioning material by compressing short synthetic filaments containing three-dimensional crimps into a prescribed shape, then subjecting the shaped block to needling or rubbing or compression, applying an adhesive agent to the shaped block of filaments obtained as described above, subsequently heating the shaped block thereby drying the adhesive agent adhering to the short filaments aggregated in the shaped block and consequently uniting the individual adjacent filaments at the points of their mutual contact, and compressing the crude cushioning material obtained as described above under pressure applied thereto in the presence of steam.

The synthetic fibers which are advantageously used for the method of this invention are polyester, polyamide, polypropylene, etc. Among these, polyester is most desirable. The fibers as a monofilament is desired to have a thickness within the range of from 30 to 2,000 deniers, preferably from 50 to 1,000 denier, and most preferably from 100 to 600 denier. The filament is required to contain three-dimensional curls. By the term "three-dimensional curls" as used herein is meant those three-dimensional curls in the broad sense of the word, such as two directional and three-directional curls, for example. A three-directional three-dimensionally crimped filament is preferred. For example, a three-directional three-dimensionally crimped filament illustrated in FIG. 2 is obtained by preparing a double-twist filament illustrated in FIG. 1 by use of a method and an apparatus disclosed by the same inventor in the specification of U.S. Pat. No. 4,154,051 and then cutting the double-twist filament to a prescribed length and untwisting it. The cut filaments aggregated in the wad are desired to have a length within the range of from 25 to 200 mm, preferably from 60 to 150 mm. Thus, with reference to FIG. 2, the part of the filament at "a" coils over the part at "b." The part at "c" coils over the part at "d." The part at "e," however, coils under the part at "f" and not over it. Thus, the section of the filament from "e" to "d" falls under two bites or coils of the helix. This is what may properly be called a disoriented helix and is very much like a helical telephone cord which gets out of whack when one of the coils thereof becomes disoriented with respect to the others.

BRIEF DESCRIPTION OF THE DRAWINGS

Now, the method and the apparatus according to the present invention will be described with reference to the accompanying drawing.

PREFERRED EMBODIMENT OF THE INVENTION

Figure 1:
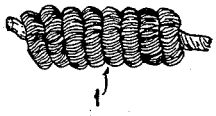
FIG. 1 is a perspective view of a double-twist filament.
Figure 2:
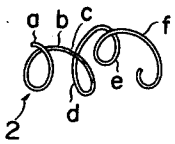
FIG. 2 is a perspective view of a three-dimensionally crimped filament.
Figure 3:
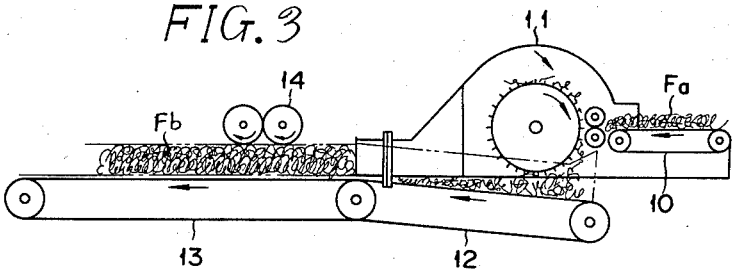
FIG. 3 is a schematic diagram of a device for compressing filaments containing three-dimensional crimps into a prescribed aggregated mass.

A continuous mass F of drawn synthetic filaments of a large denier number such as, for example, a mass $F_a$ of three-dimensionally crimped synthetic filaments 2 is forwarded on a belt conveyor 10 to an opener 11, opened and pushed in as by the force of wind between the belt conveyors 12, 13 and the rotary drum 14 and compressed to a prescribed shape as illustrated in FIG. 3. The compressed mass $F_b$ of the filaments obtained consequently possesses voids enough to permit ample change of shape. The bulk density of this compressed mass falls in the range of from 0.005 to 0.2 g/cm$^3$, preferably from 0.01 to 0.1 g/cm$^3$.

Figure 4:
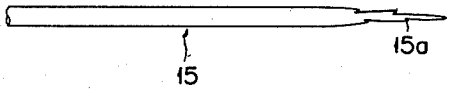
FIG. 4 is a perspective view of a needle to be used in the method of this invention.
Figure 5:
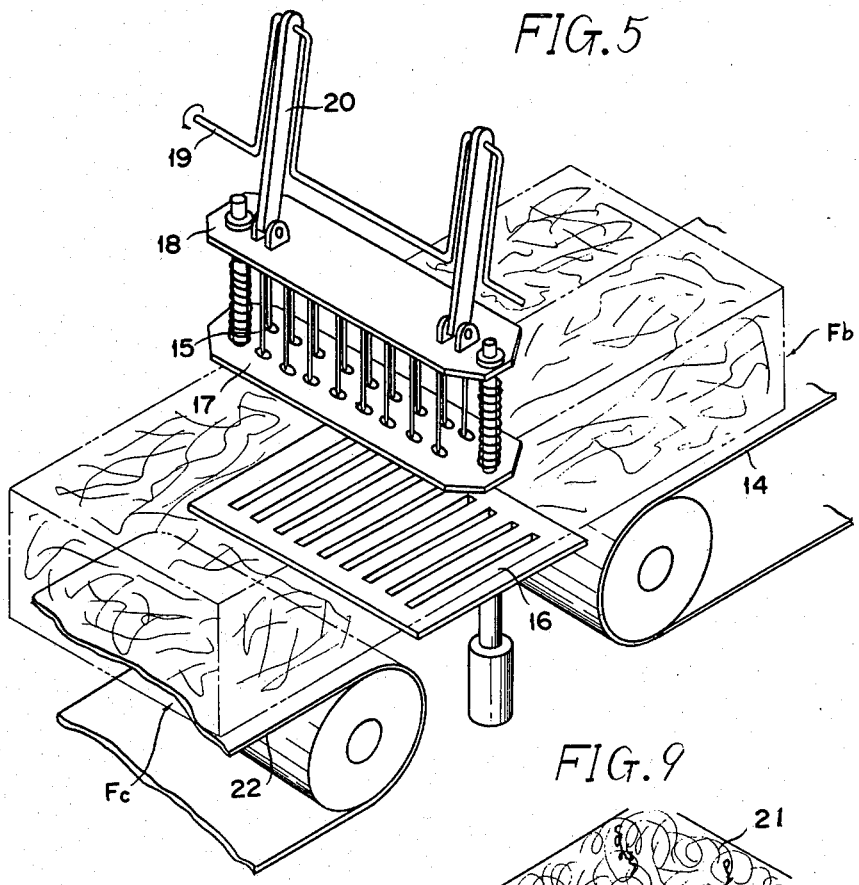
FIG. 5 is a perspective view of a needling device.

Then, the compressed mass $F_b$ of filaments is supported on the surface thereof lying perpendicularly to the direction in which the applied load is desired to manifest its impact by a flat plate such as, for example, a perforated plate or slitted plate. It is subsequently pierced at the prescribed points as often as desirable with needles each provided at the leading end thereof with at least one barb 15*a* as shown in FIG. 4. The needles 15 have their diameter and length determined by the purpose of their use. Generally their diameter is within the range of from 1.8 to 3.6 mm and their length within the range of from 50 to 1,000 mm. The needles are generally provided with 4 to 12 barbs apiece. Specifically, the compressed mass $F_b$ of filaments which has been shaped by compression while in transit on the belt conveyor 13 is supported on the lower surface thereof by the flat plate 16 such as a perforated plate, a slitted plate or a slitted belt conveyor and then is subjected to a needling treatment which is performed by vertically reciprocating a needle holder 18 to and away from the opposite surface of the compressed mass $F_b$, with or without a perforated plate 17 such as, for example, a porous plate or a slitted plate interposed between the needle holder 18 and the compressed mass, so that the needles 15 on the holder 18 pierce at a suitable density into the mass $F_b$ of filaments as shown in FIG. 5. The needles 15 are fastened in one or more rows at desired intervals to the needle holder 18. This reciprocation of the needle holder 18 is effected by rotating a crank shaft 19 and thereby operating a crank 20 which is connected to the crank shaft 19 and the needle holder 18. In the meantime, the compressed mass $F_b$ of filaments is advanced at a speed regulated to permit the needling to be effected at proper intervals. The density of these needles is widely variable with the purpose for which the finally produced cushion is used or with the compressive resilience which the cushion is desired to acquire. The density increases and the intervals between the needles are decreased in proportion as the compressive resilience increases. This density generally falls in the range of from 1 to 100 needles per 100 cm$^2$, preferably in the range of from 4 to 50 needles per 100 cm$^2$.

Although the invention has been so far described with reference to an embodiment in which the needles are inserted into the compressed mass through one surface perpendicularly to that surface, this insertion naturally may be made through two opposite surfaces or in an obligue direction or in a lateral direction.

Figure 6:
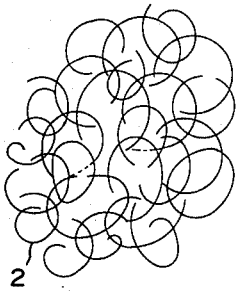
FIG. 6 is a perspective view of an aggregated mass of filaments before needling.
Figure 7:
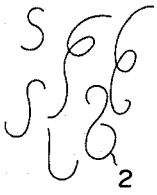
FIG. 7 is a perspective view of filaments which have been deformed by the needling.
Figure 8:
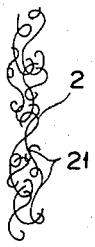
FIG. 8 is a perspective view illustrating the principle which underlies the condition of filaments entangled in one fixed direction.

When the needles 15 are pierced into the compressed mass of filaments at presecribed points in a prescribed direction as described above, annular three-dimensional crimps of filaments as illustrated in FIG. 6 are extracted or contracted in the direction of piercing in the shapes of the letters L, J and 3 and in the shape of waves as shown in FIG. 7. Consequently, the three-dimensional crimps of filaments 2 are in the various shapes mentioned above mutually entangled in various parts. The degree of entanglement of the individual filaments, therefore becomes conspicuous as compared with other portions. The points of contact 21 are distributed preponderantly in the direction in which the needles 15 have been pierced into the compressed mass. It is believed that, by suitably distributing the portions wherein the three-dimensional crimps possess directionality and the portions wherein the crimps (annular) lack directionality and adjusting the distribution of points of contact, desired load characteristics can be imparted to the cushion at prescribed points in a prescribed direction. In this case, the bulk density of the compressed mass $F_c$ of filaments falls generally in the range of from 0.005 to 0.2 g/cm$^3$ and preferably in the range of from 0.01 to 0.1 g/cm$^3$.

In the place of or in conjunction with the needling device described above, a rubbing device may be used to give a rubbing treatment to the aforementioned compressed mass of filaments. The rubbing device is designed to cause horizontal bars fastened to the leading ends of rods to be vertically reciprocated by means of a crank, so as to rub the compressed mass of filaments until the mass acquires a desired bulk density. Instead of the needling or rubbing treatment, the compressed mass may be further compressed to about one third of the original thickness.

Figure 9:
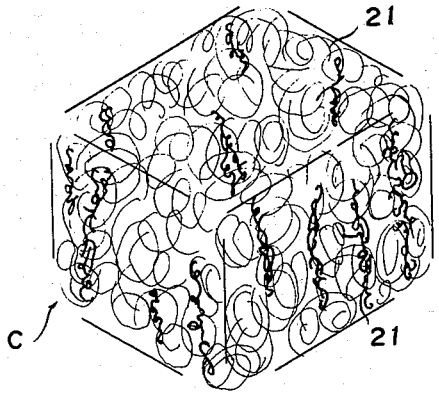
FIG. 9 is a perspective view of a cushion provided by this invention.

Subsequently, the shaped mass of filaments $F_c$ which has undergone the needling and/or rubbing or compression treatment is forwarded by a belt conveyor 22 to the next step of adhesion. In this step, the adjacent three-dimensionally crimped filaments 2 in the compressed mass are united with an adhesive agent at the points of their mutual contact existing from the beginning and the points of contact newly formed in consequence of the needling or rubbing treatment, to give rise to a cushioning material contemplated by this invention as shown in FIG. 9. The amount of the adhesive agent to be applied to the compressed mass is generally in the range of from 10 to 300 g, preferably from 50 to 250 g, in solids content per 100 g of filaments. The cushion of this invention which is obtained as described above has a bulk density in the range of from 0.01 to 0.5 g/cm$^3$, preferably from 0.03 to 0.2 g/cm$^3$.

The treatment of adhesion of the shaped mass of three-dimensionally crimped filaments which has undergone the needling treatment and/or rubbing or compression treatment is effected by spraying the adhesive agent downwardly onto the shaped mass or immersing the shaped mass in a bath of the adhesive agent thereby causing the adhesive agent to adhere to the filaments, and keeping the shaped mass wet with the adhesive agent in an electric furnace, an infrared ray furnace or a hot blast furnace at temperatures within the range of from 80° to 200° C., preferably from 100° to 160° C., for a period of 10 to 60 minutes, preferably 15 to 40 minutes to dry or vulcanize the adhesive agent. Otherwise, the adhesive agent applied to the filaments may be dried, as disclosed in U.S. Ser. No. 107,364, filed Dec. 26, 1979, now U.S. Pat. No. 4,298,418, granted Nov. 3, 1981, by pulling out the shaped mass $F_c$ in a substantially vertical direction and, at the same time, subjecting the mass to dielectric heating with high-frequency waves. In this case, the frequency of the waves falls in the range of from 1 MHz to 300 GHz, preferably from 10 MHz to 30 GHz, for example.

Typical examples of adhesive agents usable for this purpose include synthetic rubbers such as styrene-butadiene rubber, acrylonitrile-butadiene rubber, chloroprene rubber, and urethane rubber, natural rubbers, vinyl acetate type adhesive agents, cellulose acetate type adhesive agents, and acrylic type adhesive agents. They can be used in the form of a latex, an emulsion or a solution, preferably in the form of a latex or an emulsion.

In this case, the adhesive agents described above can be used either singly or in various combinations. The adhesion, however, can be accomplished with better results by first uniting the adjacent filaments with a synthetic rubber type adhesive agent and subsequently treating the whole shaped mass with a natural rubber type adhesive agent. To be specific, the fastness of the union of the adjacent filaments by the medium of the synthetic rubber type adhesive agent, the flexibility of the cushion as a whole, and the freedom of the cushion from loss of hysteresis and from compression set are improved by first uniting the adjacent filaments in the shaped mass at the points of their mutual contact with the synthetic rubber type adhesive agent possessing high adhesiveness to the synthetic filaments and subsequently treating the whole shaped mass with a natural rubber type adhesive agent. Besides, the preparatory application of the synthetic rubber type adhesive agent serves the purpose of enhancing the relatively low adhesive power the natural rubber type adhesive agent manifests on the synthetic filaments. In this case, the amount of the synthetic rubber latex and that of the natural rubber latex to be applied to the filaments are desired to be substantially equal to each other. The total of these amounts is substantially the same as the amount in which the synthetic rubber latex alone is applied as conventionally practised.

The crude cushioning material produced as described above is delivered to a press provided with a steam injection nozzle. In this press, the crude cushioning material is compressed at temperatures in the range of from 100° to 140° C., preferably from 105° to 120° C., for a period in the range of from 1 to 30 minutes, preferably from 2 to 10 minutes, with steam injected through the nozzle. Then, the applied pressure is released and the injection of steam is discontinued and the compressed mass is cooled as with air or water and removed from the press. Thus, a cushion is obtained. This compression with steam is carried out in such a manner that the ratio of compression reached a level within the range of from 5 to 40%, preferably from 10 to 30%, of the thickness of the crude cushioning material.

The method so far described mainly comprises treating the shaped mass with the adhesive agent of the kind mentioned above, then thermally drying and vulcanizing the adhesive agent and subjecting this mass to compression with steam. Optionally, the cushioning material which has been compressed with steam may be further treated with the adhesive agent and subjected to heating to be dried and vulcanized. In this case, the cushioning material is obtained with still better results by first subjecting the shaped mass of filaments to the treatment for adhesion by use of a synthetic rubber type adhesive agent, then thermally drying the mass to produce a crude cushioning material, subsequently compressing the crude cushioning material with steam under the aforementioned conditions, subjecting a cushioning material thus produced to an additional treatment for adhesion by use of a natural rubber type adhesive agent, and then thermally drying the cushioning material to vulcanize the adhesive agent. Even when the treatment with the adhesive agent is further performed after the compression with steam, the total of the amount of the adhesive agent used before and that used after the compression with steam should be limited within the range specified above.

When the compression with steam described above is carried out with the ratio of compression regulated within the range of from 5 to 40%, the surface ruggedness possessed by the crude cushioning material is alleviated and the initial loss of shape suffered by the produced cushion is eliminated. Even after prolonged repetitive use, the cushioning material enjoys greatly improved durability because the phenomena of loss of shape due to residual strain is notably repressed. Of course, the application of pressure of steam can be effected batchwise or continuously to suit the occasion.

Now, the present invention will be described more specifically with reference to a working example.

EXAMPLE

Three-dimensionally crimped short filaments about 60 mm in length formed by combining and twisting 300 denier polyester monofilaments into a total filament 300,000 denier in thickness by a method described in U.S. Pat. No. 4,154,051 were compressed into a mass, subjected to needling at a ratio of about 16 needles per 100 $cm^2$ wetted with a styrene-butadiene rubber (SBR) type adhesive agent latex by the spray method, dried with hot air at a temperature of 120° C. for 30 minutes, immersed in a natural rubber type adhesive agent latex comprising 100 parts by weight of natural rubber latex (60% by weight of solids content), 1 to 3 parts by weight of a sulfur dispersant 6 to 7 parts by weight of zinc white, 1 to 3 parts by weight of a dithiocarbamate type vulcanization accelerator (Noxeller PX) and 30 parts by weight of water, then lifted up in a vertical direction from the latex, and exposed to dielectric heating by high-frequency waves of a frequency of 2,450 MHz at a power density of about 1 $Kwh/cm^3$ to produce a crude cushioning material. The crude cushioning material had a bulk density of 0.07 $g/cm^3$ and was composed of 33% by weight of filaments, 17% by weight of natural rubber (solids content) and 50% by weight of SBR (solids content).

Figure 10:
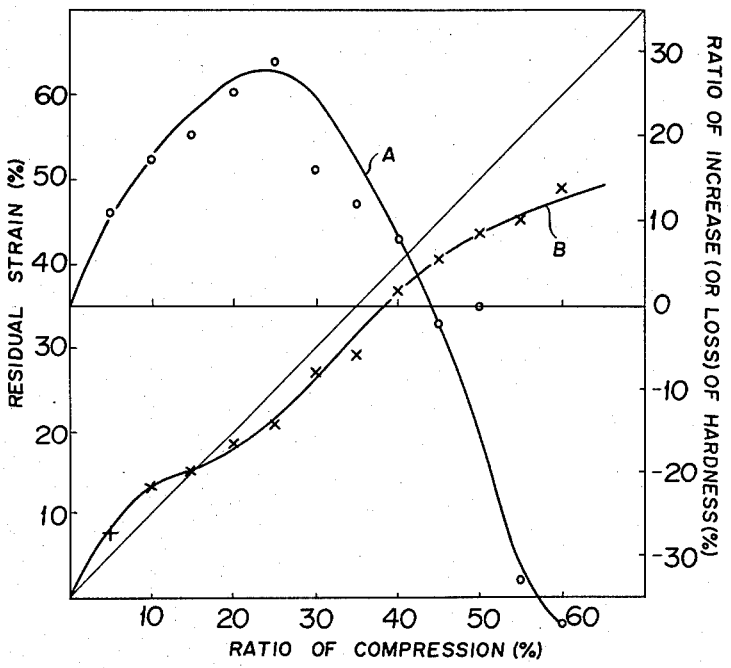
FIG. 10 is a graph showing the relation of the residual strain and the increase ratio of hardness with the ratio of compression as determined of the cushioning material obtained by the method of this invention.

The resultant flat plate of crude cushioning material was cut to a prescribed size, delivered into a press provided with a steam injection nozzle, compressed with steam of 1 atmosphere at a temperature of 100° C. for 3 minutes to a stated thickness (compression ratio). Then it was relieved of the applied pressure and cooled with air, to afford a cushioning material. This cushioning material was tested for physical properties by the method of Japanese Industrial Standard (JIS) K-6382, with necessary modifications. The results were as shown in Table 1. The results of this table are graphically shown in FIG. 10. In the graph, the curve A represents the ratio of increase of hardness vs. the ratio of compression and the curve B the residual strain vs. the ratio of compression. The curve B represents 100% residual strain.

TABLE 1

| Run No. | Compression ratio (%) | Initial thickness (mm) | Initial hardness (kg) | Compressed thickness (mm) (1) | Thickness after compression (mm) | Hardness after compression (kg) (2) | Compression ratio (%) | Loss of hardness (3) |
|---|---|---|---|---|---|---|---|---|
| 1 | 5 | 79.8 | 29.8 | 75.8 | 73.6 | 33.1 | 7.8 | +11 |
| 2 | 10 | 74.1 | 21.0 | 66.7 | 64.4 | 24.6 | 13.1 | +17 |
| 3 | 15 | 75.6 | 27.0 | 64.3 | 64.2 | 32.4 | 15.1 | +20 |
| 4 | 20 | 85.3 | 25.9 | 68.2 | 69.6 | 32.4 | 18.4 | +25 |
| 5 | 25 | 79.2 | 22.6 | 59.4 | 62.4 | 29.3 | 21.1 | +29 |
| 6 | 30 | 77.3 | 24.1 | 54.1 | 56.2 | 28.0 | 27.3 | +16 |
| 7 | 35 | 80.6 | 27.7 | 52.1 | 56.6 | 30.9 | 29.8 | +12 |
| 8 | 40 | 89.4 | 26.6 | 53.6 | 56.2 | 28.8 | 37.1 | +8 |
| 9 | 45 | 83.4 | 26.1 | 45.9 | 49.5 | 25.6 | 40.6 | −2 |
| 10 | 50 | 84.2 | 26.3 | 42.1 | 47.6 | 26.2 | 43.5 | 0 |
| 11 | 55 | 80.6 | 31.3 | 36.3 | 44.3 | 20.9 | 45.0 | −33 |
| 12 | 60 | 84.3 | 33.9 | 33.7 | 43.0 | 21.0 | 49.0 | −38 |

(1) The compressed thickness is an ideal compressed thickness obtained by calculation.
(2) The hardness after compression denotes what is called "loss of shape."
(3) In the loss of hardness (%), the values with the plus sign represent increases of hardness and those with the minus sign represent decreases of hardness.

What is claimed is:

1. A method for the manufacture of a cushioning material, comprising the steps of compressing three-dimensionally crimped short synthetic filaments to form a shaped mass of filaments, applying an adhesive agent to the resultant shaped mass of filaments, then heating the shaped mass thereby drying the adhesive agent adhering to said short filaments and uniting adjacent filaments at the points of their mutual contact, and pressing the resultant crude cushioning material in the presence of steam thereby compressing the crude cushioning material.

2. A method according to claims 1, wherein the synthetic filaments are monofilaments having a thickness within the range of from 30 to 2,000 denier.

3. A method according to claims 1, wherein the synthetic filaments comprise an aggregate of three-directionally crimped filaments.

4. A method according to claims 1, wherein the crude cushioning has a bulk density within the range of from 0.01 to 0.5 g/cm$^3$.

5. A method according to claims 1, wherein the adhesive agent is used in an amount within the range of from 10 to 300 g as solids content per 100 g of filaments.

6. A method according to claims 1, wherein the compression is effected to a level within the range of from 5 to 40% under pressure applied in the presence of steam.

7. A method according to claim 1, wherein the synthetic filaments are monofilaments having a thickness within the range of from 30 to 2,000 denier, and wherein the compression is effected to a level within the range of from 10 to 30% under pressure applied in the presence of steam.

8. A method according to claim 1, which further comprises additionally applying an adhesive agent to the cushioning material and heating to dry the cushioning material wet with the adhesive agent.

9. A method of claim 1, in which a needling step is interposed between the compressing step and the application of the adhesive agent.

* * * * *